United States Patent [19]

Punako et al.

[11] Patent Number: 4,648,670

[45] Date of Patent: Mar. 10, 1987

[54] ELECTRICAL CONNECTOR ASSEMBLY HAVING ANTI-DECOUPLING MECHANISM

[75] Inventors: Stephen Punako; David W. MacAvoy, both of Bainbridge, N.Y.

[73] Assignee: Allied Corporation, Morristown, N.J.

[21] Appl. No.: 147,699

[22] Filed: May 7, 1980

[51] Int. Cl.[4] ..... H01R 13/62

[52] U.S. Cl. ..... 339/89 R; 339/90 R; 339/91 R; 285/87; 285/319; 411/328; 74/577 M

[58] Field of Search ..... 339/89 R, 89 C, 89 M, 339/90 R, 90 C, 91 R, DIG. 2; 285/87, 88, 308, 319; 74/575, 576, 577 R, 577 S, 577 SF, 577 M; 403/320, 342; 411/316, 317, 322, 326-329

[56] References Cited

U.S. PATENT DOCUMENTS

| | | | |
|---|---|---|---|
| 1,778,368 | 10/1930 | Monnier . | |
| 2,926,547 | 3/1960 | Watson | 74/575 |
| 3,142,149 | 7/1964 | Hays | 74/577 SF |
| 3,650,157 | 3/1972 | Strathearn et al. | 74/575 X |
| 3,892,458 | 7/1975 | Clark | 339/DIG. 2 |
| 4,030,798 | 6/1977 | Paoli | 339/89 R |
| 4,066,315 | 1/1978 | Arneson | 339/113 R X |
| 4,109,990 | 8/1978 | Waldron et al. | 339/113 R X |
| 4,152,039 | 5/1979 | Shah | 339/DIG. 2 X |
| 4,165,910 | 8/1979 | Anderson | 339/DIG. 2 X |
| 4,239,314 | 12/1980 | Anderson | 339/89 M |
| 4,272,144 | 6/1981 | Brush et al. | 339/89 R |

FOREIGN PATENT DOCUMENTS

| | | |
|---|---|---|
| 469020 | 7/1914 | France . |
| 1195451 | 11/1959 | France . |

*Primary Examiner*—Robert P. Olszewski
*Attorney, Agent, or Firm*—C. D. Lacina

[57] ABSTRACT

An anti-decoupling mechanism for preventing unwanted decoupling of an electrical connector as a result of vibration. The decoupling mechanism includes a one-piece gull-shaped spring (400) mounted to a connector coupling ring (300). The spring (400) includes a central portion (410) having an arcuate groove (411) formed thereon and a pair of wing members (420, 430) extending outwardly therefrom, the arcuate portion being secured in place by a pin (600) interference fit through a hole (331) disposed in the coupling ring. Each wing member includes first and second strips in superposed relation and a medial enlargement or tooth member (440) projecting radially inward from a forward surface of one of the strips and adapted to engage ratchet teeth (141) disposed on one of the connectors, the wings biasing the tooth against the ratchet teeth to increase anti-decoupling torque.

15 Claims, 8 Drawing Figures

FIG. 1
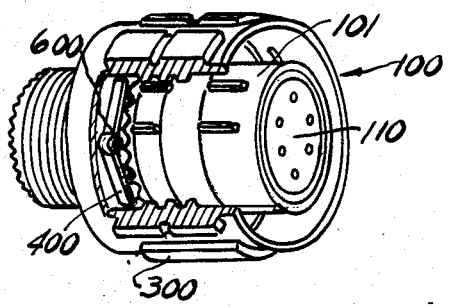
FIG. 2
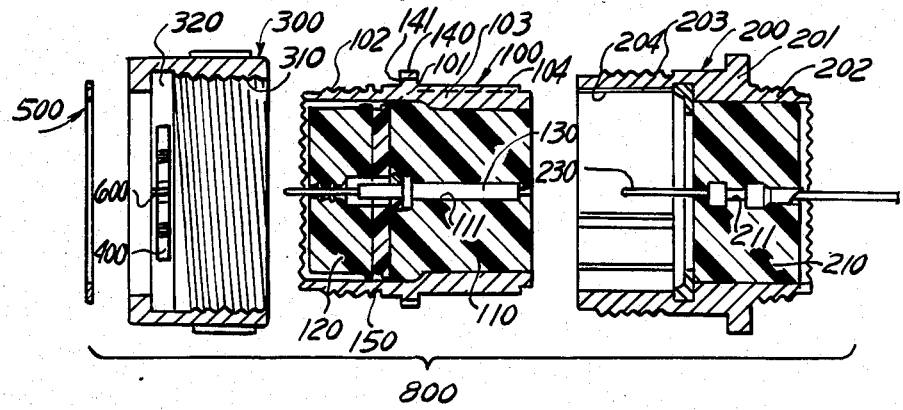
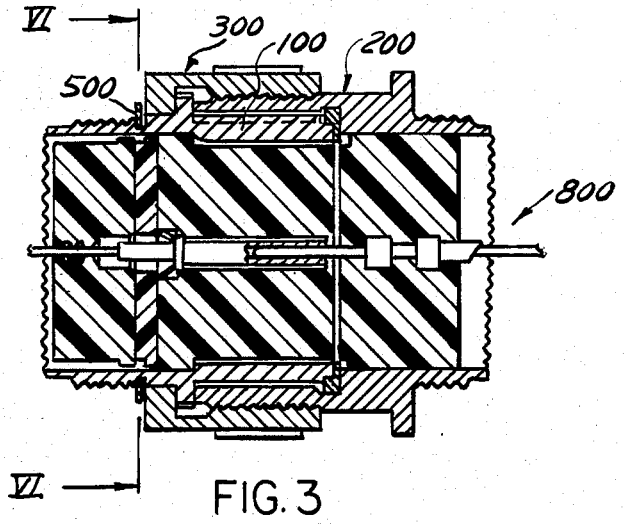
FIG. 3

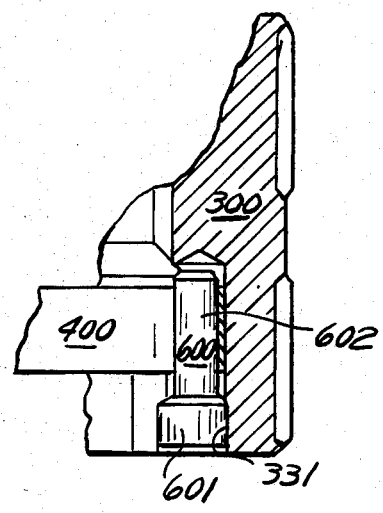
FIG. 8
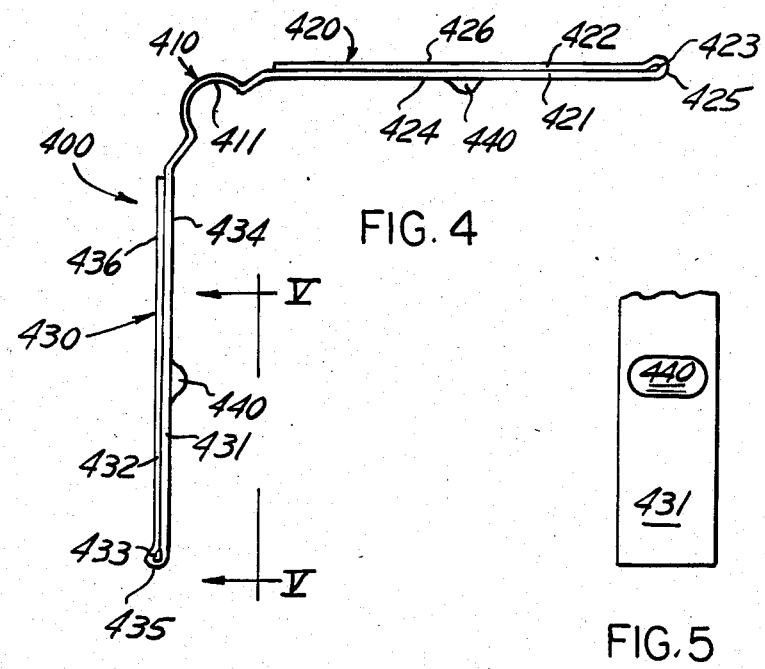
FIG. 4
FIG. 5

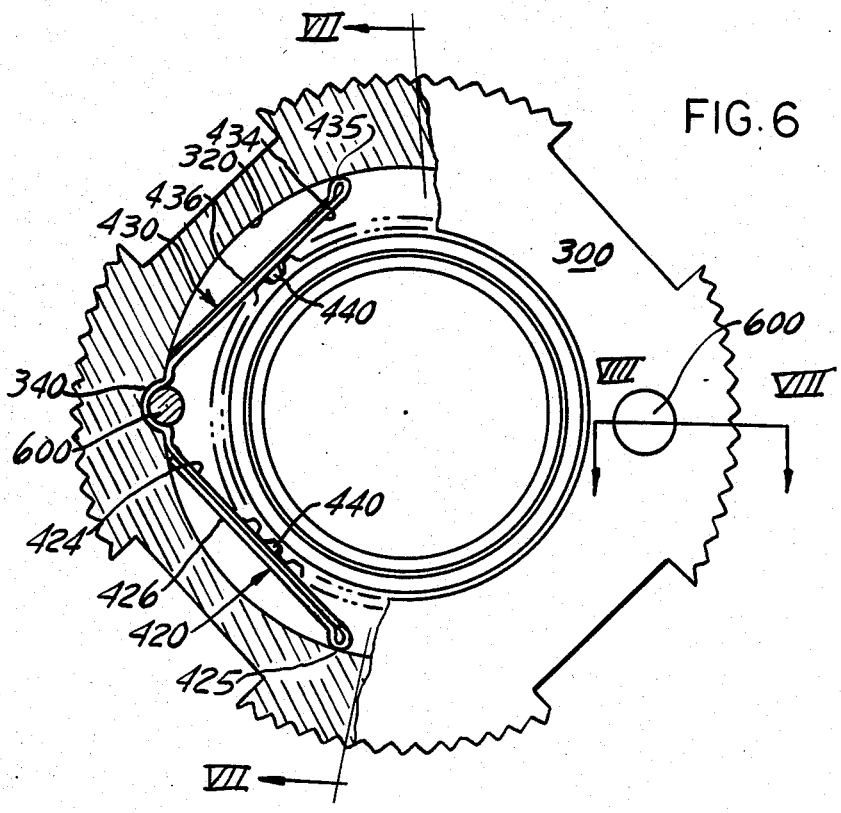
FIG. 6
FIG. 7
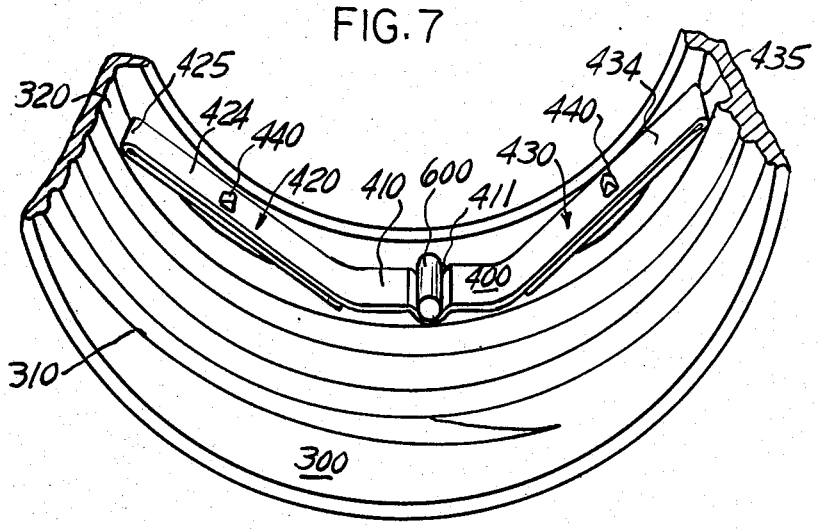

ELECTRICAL CONNECTOR ASSEMBLY HAVING ANTI-DECOUPLING MECHANISM

The present invention relates to an electrical connector assembly of the type having a pair of mateable cylindrical shells secured together by a rotatable coupling ring and more particularly to an improved anti-decoupling mechanism that retains the coupled electrical connector assembly in its mated state against vibration forces which would tend to decouple the assembly.

BACKGROUND OF THE INVENTION

There is a continuing need to improve electrical connectors to meet rigid performance standards imposed by severe environmental requirements established by aerospace applications. During mating and unmating, electrical connectors should be easily and quickly coupled and decoupled with the use of reasonable forces. Once mated and in use, however, connector assemblies must remain connected despite vibrational and/or other forces which might be applied to the connector assembly and which might tend to uncouple the connectors.

Several prior art patents have addressed themselves directly or indirectly to the problem of maintaining an assembled pair of cylindrical electrical connectors together. An approach disclosed by U.S. Pat. No. 2,984,811 to Hennessey, et al. includes providing one connector member with a plurality of spaced bayonets which locate within similarly spaced detents carried by a coupling nut when the assembly is fully mated. A prior art patent to Paole, U.S. Pat. No. 3,971,614 discloses interlocking splines. U.S. Pat. No. 2,784,385 to Ennis discloses an outer sleeve being provided with a series of exposed teeth and a spring member attached to a fixed flight to engage these teeth. U.S. Pat. No. 3,784,966 to Clark shows a spring element engaging one of three recesses. These prior art systems for retarding decoupling had the disadvantages of either being unreliable, difficult to make or prone to failure.

Another approach is typified by U.S. Pat. No. 4,109,990 to Waldron et al and by U.S. Pat. No. 4,268,103. In each of these efforts, a single spring member is disposed within a recess of a coupling nut and the spring includes a inwardly extending projection to engage ratchet teeth on the connector member to be mated. While suitable in many applications, the spring member did not always provide positive and secure engagement with the ratchet teeth and the restraining torques sometimes were not sufficient to prevent the decoupling under vibration. Mounting of the four pins shown by Waldron et al required substantial cost to drill the holes and, during interference fitment of the pins into the holes, caused burrs and/or flakes to enter the connector.

Still a further approach is shown by abandoned U.S. patent application Ser. No. 952,900 filed 10-19-78, wherein one end of a spring loaded detent pin is slidably mounted in a radial bore of a coupling nut and the other end biased into engagement with a connector detent.

There is a continuing need to provide electrical connector assemblies with a mechanism that prevents accidental decoupling, that is cheap, reliable, easy to make and assemble and which secures the assembly together.

DISCLOSURE OF THE INVENTION

Accordingly, the invention provides a quickly connectable and disconnectable electrical connector assembly that provides an adequate resistance to uncoupling forces and prevents unauthorized or accidental decoupling, thereby overcoming the limitations of the prior art systems.

In particular, the invention is characterized by a first electrical connector 100 including a shell 101 having electrical contacts mounted therein, a second electrical connector 200 including a second shell 201 having an external thread disposed therearound and electrical contacts mounted therein and mateable with the contacts in the first shell, a coupling ring 300 rotatably mounted on the first shell for selectively coupling and/or decoupling the first and second shells and having internal threads connectable with the external threads on the second shell for connecting the first and second shells together in mated relationship and means for retarding the rotational movement of the coupling ring with respect to the shells when mated. The retarding means comprise at least one "gull-shaped" leaf spring member 400 characterized by an arcuate grooved central portion 410 adapted to be mounted to the coupling ring, a pair of "wing members" 420, 430 extending outwardly from the central portion to ends 425, 435 which rest freely on an interior wall portion 320 of the coupling ring and a medial enlargement (dimple) or tooth member 440 extending inwardly from each wing for selectively engaging one of a plurality of ratchet teeth 141 circumposed around the first shell. Preferably each of the "wings" are formed by folding a sheet of metal stock over onto itself to define first and second superposed strips. The spring member is made of a resilient yieldable material which permits each wing to flex radially inwardly and outwardly but yet with the "leaf" construction to provide adequate resistance to retrograde rotation and prevent disengagement of the coupling ring. Preferably two such spring members are mounted at diametrically opposite locations in the coupling ring. Two "gull-shaped" spring members so placed assure that due to vibration if one of the wings on each spring disengages from its ratchet tooth, then the other wing will still be in engagement with another ratchet tooth and that a pair of off-set wings will still act to prevent decoupling motion.

Accordingly, it is an object of this invention to provide an improved electrical connector that is cheap, reliable, easy to make and assemble, which retains mated electrical connectors in coupled condition and prevents accidental disassembly thereof through vibration.

Another object of this invention is to provide an anti-decoupling mechanism for use with cylindrical electrical connectors to be coupled together into an assembly which substantially increases the amount of torque necessary to uncouple the assembly over that achieved in the prior art without redesign of existing connector members.

Still a further object is to provide a spring member which can be easily attached by a pin to a coupling ring of a cylindrical connector without burrs or flakes from attachment entering the connector.

Still a further object is to provide a securement of the spring member which does not permit environmental moisture or other materials and contaminants to enter the connector portion.

Yet another object of this invention is the provision of a spring member which distributes spring reaction forces about an connectable connector member.

A further object of this invention is provision of a spring member having increased stiffness.

Another object of the invention is the provision of a novel spring having a pair of superposing strips for increasing the stiffness and the bias force available to be applied against a connector from rotating.

A more specific object of the invention is to provide a one-piece spring member having folded over spring arms provided with enlarged medial portions and defining a pair free ends in contact with a connector assembly member.

The above and other objects and features of the present invention will become apparent from the following detailed description, taken in conjunction with the accompanying drawings and claims which form a part of this specification.

BRIEF DESCRIPTION OF THE DRAWINGS

FIG. 1 is a perspective view of a connector member partially cut-away to show an anti-decoupling mechanism of the present invention.

FIG. 2 is an exploded sectional view of a pair of mateable connector members and a coupling ring about to be assembled into an electrical connector assembly.

FIG. 3 is a sectional cut-away view of the connector members of FIG. 2 mated and coupled together to form the electrical connector assembly.

FIG. 4 is a plan view of a spring member according to the present invention.

FIG. 5 shows a forward face of the spring member taken along lines V—V of FIG. 4 and showing a medial tooth shaped dimple.

FIG. 6 is a partially cut-away view of the coupling ring taken along lines VI—VI of the connector assembly of FIG. 3 showing the spring member according to this invention.

FIG. 7 is a fragmented section view of the coupling ring taken along lines VII—VII of FIG. 6.

FIG. 8 is a section view taken along lines VIII—VIII of FIG. 6 showing securement of the spring member to the coupling ring.

DETAILED DESCRIPTION OF THE INVENTION

Referring now to the drawings, FIG. 1 illustrates partially in perspective and cut-away a mateable first connector member 100 incorporating an anti-decoupling device 400 according to the present invention. Depending on whether the first connector member retains mateable male (pin) or female (socket) contacts, the first connector member would be referred to respectively as a plug or a receptacle connector. The connector member 100 shown is receptacle and comprises a shell 101, a contact retaining insert 110 disposed in the shell, a coupling ring 300 rotatably disposed about the shell and a spring member 400 mounted to the coupling ring by a pin 600.

FIG. 2 illustrates a cross-sectional, exploded view of first and second electrical connector members positioned along an axis for mating into (or out of) an electrical connector assembly 800 which incorporates the principles of this invention. The electrical connector assembly 800 comprises the first connector member 100 (here considered as the receptacle), the second connector member 200 (here considered as the plug) and the coupling ring 300 about to be mounted by a retaining ring 500 to the first connector member 100 for connecting the first and second connector members together. Typical components of the first connector member 100 includes one or more female-type electrical (socket) contacts 130 retained within the shell 101 by one or more inserts 110 and 120. The first connector member shell 101 includes a rear portion 102 which is threaded for receiving a moisture sealing and/or strain relief nut (not shown) and a forward portion 103 which includes one or more axially extending projections or keys 104 for orienting the first shell 101 with respect to the second shell 201. The socket contacts 130 are mounted within passages 111 disposed in and extending through the insert 110. The first shell 101 includes an outer periphery having a medial enlargement or shoulder 140 radially disposed thereabout and on which a plurality of engageable detents in the form of ratchet teeth 141 extend therearound. These engageable detents are shown best in FIG. 6.

The second (plug) connector member 200 includes one or more male-type electrical (pin) contacts 230 that mate with the socket contact 130 disposed in the first connector member 100, each of the pin contacts 230 being retained in respective passages 211 extending through an insert 210 secured to the second shell 201. The second shell 201 includes one or more axially extending recesses or keyways 204 for receiving the respective keys 104 disposed on the first shell 101. The second shell includes a mateable forward portion 203 having external coupling threads provided thereon and a rearward portion 202.

The coupling ring 300 is mounted over the rear portion 102 of the first connector member 100 with the medial enlargement 140 providing a forward stop for the coupling ring 300. A snap ring 500, when mounted in a groove 150 on the first shell, limits rearward movement of the assembled coupling ring and captivates the coupling ring onto the rear portion of the first shell whereby the coupling ring is constrained only to rotate. The coupling ring includes internal threads 310 which are adapted to mate with the external threads on the forward portion of the second shell 201 to couple the first and second connector members 100,200 and their respective contacts 130,230 together in mated relation.

The spring member 400 is mounted by the pin 600 toward the rear of and within an undercut portion 320 of the coupling ring.

FIG. 3 shows the first and second connector members 100,200 assembled and mated and coupled together by the coupling ring 300, the internal threads of the coupling ring threadably engaged with the external threads disposed about the shell of connector member 200. One pin contact 230 is shown inserted in the socket 130 to complete an electrical interconnection.

FIG. 4 is an enlarged plan view of the spring member 400 according to the invention. The spring member is "gull-shaped" and comprises a central portion 410 having a longitudinally extending midway groove 411 and a pair of wing members 420,430 extending outwardly therefrom. Each wing member includes a first portion or strip 421,431 superposing a second portion or strip 422,432, each of the first portions 421,431 having thereon and extending therefrom a medial projection 440 for engaging one of the teeth or detents 141 disposed around the shell of the first connector member. Preferably, each wing is stamped from a sheet of metal and formed into the desired shape. The two wings generally subtend an angle of about 90°. Depending on the application, each "wing" could have a "looped" end portion 423,433, the loop being defined when the continuous portion of metal stock having top and bottom-faces is folded back about 180° and onto itself. When the metal is so folded, one portion of the bottom face superposes (confronts) another portion of the bottom face, and the top face defines a radially inward or forward surface 424,434 which faces the detent teeth 141 and a radially outward or rearward surface 426,436 which faces the interior surface of the coupling ring undercut 320.

FIG. 5 shows the medial projection 440 as being an enlarged dimple or tooth-like shaped projection.

FIG. 6 shows the coupling ring 300 cut-away and the gull-shaped leaf spring 400 mounted therein. Two such springs are provided, only one being shown by the cut away. Each of the springs are symmetrically shaped and diametrically disposed at approximately 180 degrees one from the other. The spring 400 is mounted within the undercut portion 320 of the coupling ring 300 by the detent pin 600 which extends through a stepped hole 331 in a wall 330 of the coupling ring. When the leaf spring is mounted in the undercut 320 of the coupling ring, each of the medial dimples 440 engage a detent (gear teeth) 141 on the first connector member shell 101. The tooth extends from the forward surface 424,434 radially inward from an imaginary straight line drawn between the ends of the spring and towards the shell. Each of the wing loop end portions are biased to freely ride on the interior surface of the coupling ring undercut.

FIG. 7 shows a fragmentary cut-away view of the coupling ring 300 and the spring mounted in the undercut 320 with the pin 600 securing the central portion 411 to the ring and the distal free ends 425,435 of each wing 420, 430 being biased against the interior wall of the undercut.

FIG. 8 shows the securement of the spring member to the coupling nut. A stepped spring detent pin 600 having head 601 and shank portions 602 is interference or press fit into the stepped-hole 331 which limits the inward movement of the pin into the coupling ring. The pin serves to provide a snug or slip-fit for the spring 400 and provide a certain amount of fixed-free flexural movement of the wings during the rotation of the coupling ring. The interference fit eliminates the problem of burrs or metal scraps from entering the connector.

Broadly speaking, the "wing members" are intended to be "leaf springs" wherein a first member or strip is in superposing relation with a second member or strip, the strips serving to increase the stiffness of the spring, which in turn increases the spring load or bias of the tooth against a detent, thereby retarding rotation of the coupled assembly. Such a wing could be formed by folding a continuous sheet of resilient material over upon itself, as disclosed herein, or by laminating two resilient strips together, one on top of the other by bonding. Use of a spring as disclosed and having two wings has unexpected advantages. First, if due to vibration, should one tooth 440 of one wing happen to be forced out from engagement with its detent, the other tooth could still be biased into engagement with its detent. If both teeth 440 have outwardly directed radial forces acting on them, the reaction forces are shouldered by the central portion 340 of the coupling ring and not on the pin.

Further, by provision of such a detent pin and spring member, a given or known vibration environment would permit the user to interchange spring members (having weaker/stronger characteristics) without redesigning the entire connector assembly.

While a preferred embodiment of the invention has been disclosed, it will be apparent to those skilled in the art that many changes may be made to the invention with the spirit as set forth in the preceding description. Further, in some instances, certain features of the invention may be used to the advantage without corresponding use of other features. For example, other configurations of spring, or springs having plastic portions engaging the metal teeth, may be desirable. In some instances, the substitution of plastic for the ratchet teeth may be advisable, which would allow the use of a metal spring. Accordingly, it is intended that the preceding description of the invention be used merely to illustrate the principle of the invention and not to limit the scope thereof, which is set forth in the following claims.

Having thus described the invention, what is claimed is:

1. In an electrical connector having a first electrical connector including a shell having a plurality of electrical contacts mounted therein, a second electrical connector including a second shell having a plurality of electrical contacts mounted therein and mateable with the contacts in the first shell, said second shell having an external thread thereon, and a coupling ring rotatably mounted on the first shell and adapted to selectively couple and decouple said first shell from said second shell, said coupling ring having an interior wall provided with internal threads connectable with the external threads on the second shell for connecting the first and second shells together and thereby holding respective contacts in the mated relationship, means for retarding the rotational movement of the coupling ring with respect to the shells, said retarding means comprising:

a radial shoulder extending around the outer periphery of said first shell and having an outer circumferential surface thereof provided with a plurality of engageable teeth; and an integrally stamped and formed gullwing shaped leaf spring member including a central portion mounted to the coupling ring, and a pair of wings each extending from the central portion to a distal end disposed against the interior wall of the coupling ring, each of said wings including first and second portions with the second portion being integral with and folded over and onto the first portion, each said first portion having a forward surface facing radially inward in the direction of said first shell and including an enlarged medial portion for engaging the teeth to retard rotational movement, said medial portion extending inwardly of the forward surface in a radial direction from an imaginary line drawn between the ends of the wing first portion in the region of the coupling ring interior wall and towards the first shell.

2. An electrical connector assembly as recited in claim 1 wherein said central portion includes an arcuately formed midway portion, said coupling ring wall includes a bore extending longitudinally therethrough and further including a pin member interference fit within the hole, said pin mounting said midway portion snugly against the interior wall of the coupling ring.

3. In an electrical connector assembly including a first electrical connector having a shell and an electrical contact mounted therein, a second electrical connector having a second shell and an electrical contact mounted therein and mateable with the contact in the first shell, one said shell having a radial flange disposed on its outer periphery with the outer circumferential face of the flange being provided with engageable detents, and a coupling ring having an inner wall and rotatably mounted on the one shell for selectively coupling and decoupling said shells, means for retarding rotational movement of the coupling ring with respect to the shells, said retarding means comprising a gullwing shaped spring member having a central portion mounted to the coupling ring and a pair of wings extending therefrom to distal free ends each disposed adjacent the inner wall of the coupling ring, each said wing including two resilient members with the first member being secured to and disposed radially inward of the second member and facing in the direction of said detents, each said first member including a medial portion that extends inwardly of the coupling ring in a radial direction from an imaginary straight line between the ends of the first member of the wing and towards the first shell for engaging the detents to retard rotational movement.

4. An electrical connector assembly as recited in claim 3 wherein the spring member is stamped and formed from resilient metallic material.

5. An electrical connector assembly as recited in claim 3 wherein the medial portion is integral with the first member of the wing.

6. An electrical connector assembly as recited in claim 5 wherein the free ends of each wing include a looped portion, the looped portion being formed as the result of an elongated strip of the metallic material being folded over and upon itself in superposed relation.

7. An electrical connector assembly as recited in claim 5 wherein said second member is secured to said first member at the distal free end of said wing.

8. For an electrical connector assembly having first and second connector members movable relative to each other along an axis into and out of mated position and coupled together in the mated position by a coupling ring rotatably mounted on one connector member for coupling engagement with the other connector member, the coupling ring having an interior wall provided with an undercut, a spring member comprising:

a resilient yieldable body member stamped and formed from a single piece of sheet metal into a gullwing shape defined by a central portion that is adapted to be secured to the coupling ring and by a pair of wings which extend outwardly from the central portion, each said wing being defined by an elongated portion of said sheet metal being folded approximately 180° onto itself to form upper and lower sheet portions, the lower sheet portions facing the undercut, the upper sheet portions facing said one connector, and a looped end being formed in the region adjacent to the folded over portion and adapted to be biased into contact with the undercut, each upper sheet portion having a medial enlargement adapted to face inwardly for engaging one of a plurality of detents arranged about the periphery of the one connector.

9. A spring member as recited in claim 8 wherein the wings subtend an angle of approximately 90°.

10. A first electrical connector member adapted to be mated to a second electrical connector member, said first electrical connector member comprising:

a shell having a plurality of engageable detents;

a coupling ring constrained to rotable about said shell and adapted to engage said second connector member, said coupling ring having an interior surface facing the external perihpery of said shell; and a gullwing shaped spring member carried by the coupling ring for resisting rotation of the coupling ring relative to said shell, said spring member including a central body abutting against the interior surface and a pair of wing members, each wing member having one end portion pressing against the interior surface of the coupling ring, each of said wing members being generally disposed at right angles and including first and second strips disposed in superposing relation with the first strip including an enlarged medial portion for engaging successive of the detents, said medial portion extending inwardly towards the first connector member shell in a radial direction from an imaginary line drawn between the ends of the first strip, rotation of the coupling ring advancing the medial portion between successive detents to thereby retard rotational movement.

11. The invention as recited in claim 10 wherein said first and second strips are arranged to superpose by having a continuous sheet of metal stock being bent substantially 180° back onto itself, the band defining said other end portion for each of said wing members.

12. The invention as recited in claim 11 wherein the central body of said spring member includes a semi-cylindrical wall portion, defining a longitudinally extending groove, and said coupling ring comprises an annular shoulder provided with a longitudinal through hole, a semi-cylinderical wall defining an arcuate recess in the interior surface for receiving the wall portion of said spring, and a detent pin having head and shank portions with the shank portion being adapted to be received within the through hole whereby to retain the central body of the spring in the recess of said coupling ring.

13. In combination with an electrical connector assembly having first and second connector members movable relative to each other along an axis into and out of mated position, a coupling ring constrained to rotate on one of the connector members for coupling and securing the assembly in the mated position and anti-decoupling means, the improvement in the anti-decoupling means comprising a gullwing shaped spring member having a central portion that is adapted to be secured in an undercut in the coupling ring and a pair of resilient wings each of which extend from the central portion, said wings each being defined by a sheet portion being folded approximately 180° onto itself and having upper and lower surfaces, the lower surface facing the undercut and the upper surface facing one of the connector members, the folded over portion defining a looped end region biased to slidably contact the undercut, each of said upper surfaces having a medial enlargement facing inwardly engaging successive ones of a plurality of detents arranged about the periphery of the one connector, whereby said resilient wings wings are biased radially inwardly and outwardly.

14. An electrical connector assembly having an anti-decoupling mechanism including a first shell having a contact mounted therein, a second shell having a contact mounted therein and matable with the contact in the first shell a coupling ring having an inner wall and rotatably mounted on the first shell for selectively coupling and/or decoupling said shells, and means for retarding rotational movement of the coupling ring with respect to the shells, characterized in that said retarding means comprises a radial shoulder disposed around the first shell with an outer surface thereof facing toward the inner wall of the coupling ring, said shoulder being provided with engageable detents and a gullwing shaped detent engaging spring member having a central portion and a pair of wings extending therefrom, the central portion being mounted to the coupling ring and the wings having free ends disposed adjacent the inner wall of the coupling ring, each of said wings subtending an angle of approximately 90° and each having an enlarged medial portion for engaging the detents to retard rotational movement, each said enlarged medial portion extending inwardly from its respective wing towards said first shell in a radial direction from an imaginary line drawn between the ends of the wing in the region of the coupling ring inner wall.

15. The connector assembly as recited in claim 14 wherein each said wing includes a first and second resilient member, each said first member being secured to and disposed radially inward of the respective second member and having a top surface facing in the direction of said engageable detents, each top surface of the respective first members including said enlarged medial portion.

* * * * *